United States Patent [19]

Inagaki et al.

[11] Patent Number: 4,502,850

[45] Date of Patent: Mar. 5, 1985

[54] ROTARY COMPRESSOR

[75] Inventors: Mitsuo Inagaki; Seitoku Ito, both of Okazaki; Hisashi Aoki, Kariya, all of Japan

[73] Assignees: Nippon Soken, Inc., Nishio; Nippondenso Co., Ltd., Kariya, both of Japan

[21] Appl. No.: 364,608

[22] Filed: Apr. 1, 1982

[30] Foreign Application Priority Data

Apr. 7, 1981 [JP] Japan ..... 56-52132
Feb. 15, 1982 [JP] Japan ..... 57-021227

[51] Int. Cl.[3] ..... F04B 49/02

[52] U.S. Cl. ..... 417/440; 417/310; 418/185

[58] Field of Search ..... 417/440, 310; 418/185

[56] References Cited

U.S. PATENT DOCUMENTS

| | | | |
|---|---|---|---|
| 1,270,872 | 7/1918 | Roberts | 417/440 |
| 2,684,631 | 7/1954 | Anthony et al. | 417/440 |
| 2,899,903 | 8/1959 | Ryder | 417/440 |
| 2,918,009 | 12/1959 | Creuoisier | 418/185 |
| 3,120,814 | 2/1964 | Mueller | 418/185 |
| 3,451,614 | 6/1969 | Tosh | 417/440 |
| 3,810,721 | 5/1974 | Eyer | 417/440 |
| 4,137,018 | 1/1979 | Brucker | 417/440 |
| 4,298,316 | 11/1981 | Strikis | 417/310 |
| 4,421,462 | 12/1983 | Ohne | 417/310 |
| 4,441,863 | 4/1984 | Hotta et al. | 417/310 |

FOREIGN PATENT DOCUMENTS

| | | | |
|---|---|---|---|
| 198387 | 12/1982 | Japan | 417/310 |

*Primary Examiner*—William L. Freeh
*Attorney, Agent, or Firm*—Kenyon & Kenyon

[57] ABSTRACT

A rotary compressor is provided with a rotary valve arranged rotatably in the housing unit. The rotary valve is partially exposed to an interior space of the housing unit. The interior space is divided into a plurality of variable working spaces. A return port is formed in the rotary valve for feeding a cooling medium into an inlet port from the working space. A quantity of the cooling medium discharged from the working space through an outlet port is changed in accordance with the rotation of the rotary valve controlled by the actuator.

13 Claims, 21 Drawing Figures

Fig. 2
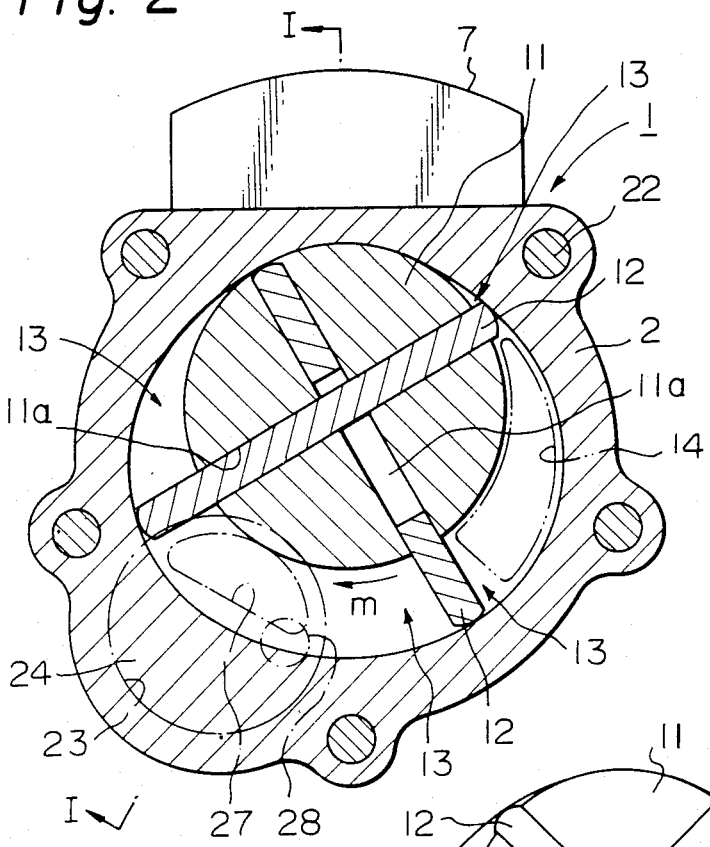
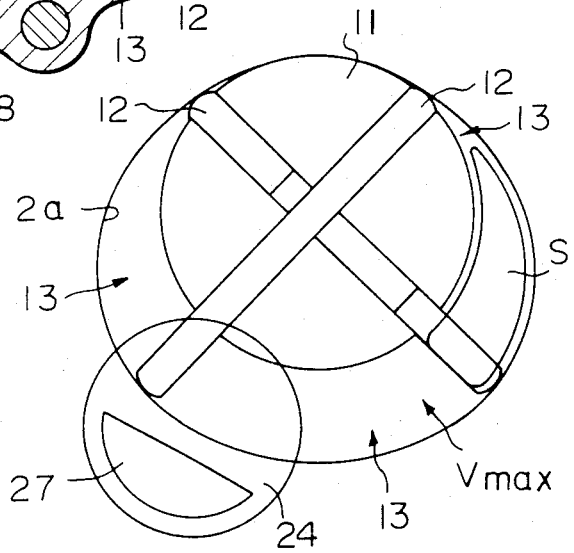
Fig. 3

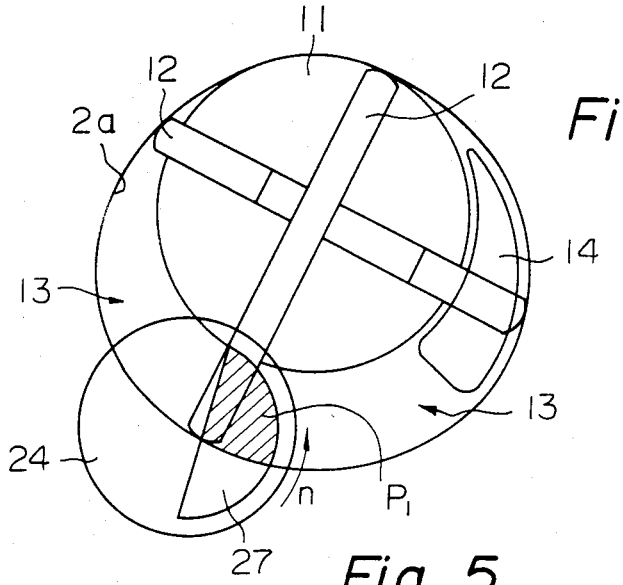
Fig. 4
Fig. 5
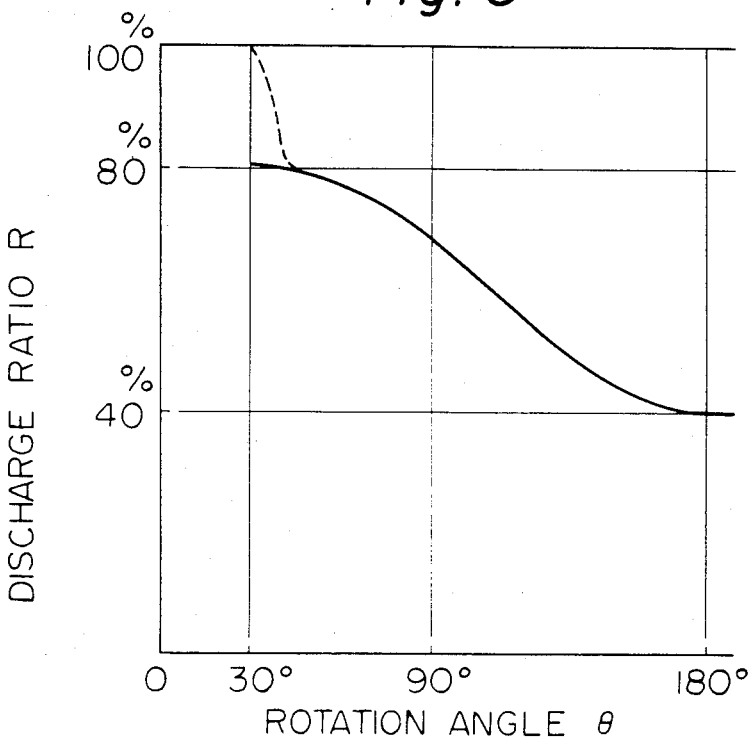

ROTARY COMPRESSOR

BACKGROUND OF THE INVENTION (1) Field of the Invention

The present invention relates to a rotary compressor. More particularly, the present invention relates to a variable volume type of rotary compressor which is effectively used as a cooling medium compressor of a cooling system for an automobile.

(2) Description of the Prior Art

A rotary compressor, used for compressing a cooling medium in a cooling system for an automobile, is ordinarily connected to a crank pulley of an engine through an electromagnetic clutch and rotated in a relatively broad range of speeds from about 700 to about 6000 r.p.m.. The volume or capacity of the rotary compressor is predetermined primarily to produce a cooling effect which is sufficient even at a low rotational speed. Accordingly, when the speed of rotation is high, or the cooling load is low, the cooling capacity is then excessive.

If the cooling capacity is excessive, the suction side pressure of the rotary compressor is reduced, and, therefore, the compression ratio is reduced, resulting in a reduction of the efficiency of the rotary compressor and also in a decrease in the fuel efficiency of the automobile.

In conventional systems, cooling is adjusted by detecting the temperature in the driver's compartment of the car and selectively energizing an electromagnetic clutch in response to the detected temperature. However, if this method is adopted, the variations in the load of the engine are large, and it is therefore impossible to obtain good engine response while driving. In addition, since the compressor is intermittently operated, the temperature in the driver's compartment is always changing relative to a desired temperature and, as a result, a stable cooling effect cannot be obtained. When the rotary compressor is used for an air conditioner in a house, the problem of the varying degree of cooling due to the intermittent operation of the compressor similarly arises.

In the case of a rotary compressor of a cooling system for an automobile, the range of the rotation speed is very broad and there is a wide variation in cooling the driver's compartment, for example, from a high load condition in the middle of summer to a low load condition at the beginning of spring. Accordingly, in this field, there exists a need for a type of rotary compressor having a simple structure, in which the quantity of the cooling medium discharged from the compressor is changed within a broad range as gradually as possible.

It has been experimentally confirmed that when a rotary compressor is operated at the quantity smaller by about 20% than the maximum quantity, lubricating oil present in the cooler system stays in a condenser or receiver of the cooler system and is not supplied to the rotary compressor, with the result that the durability and efficiency of the rotary compressor is drastically reduced.

It is therefore an object of the present invention to provide a rotary compressor having a simple structure, in which the quantity of the cooling medium discharged from the compressor can be changed, within a broad range, as gradually as possible and in which reduction of the durability and efficiency can be prevented.

SUMMARY OF THE INVENTION

In accordance with the present invention, there is provided a rotary compressor comprising:

a housing unit having therein a peripheral inner wall;

a rotor, having therein at least one radial slot, said rotor being eccentrically and rotatably arranged within said housing unit so that an interior space is formed between said peripheral inner wall and the rotor, said interior space comprising a suction region which has a radial width increasing toward the rotating direction of the rotor, and a compression region which has a radial width decreasing toward the rotating direction of the rotor;

at least one vane slidably arranged in the slot of said rotor and having an end which always sealingly contacts the peripheral inner wall of said housing unit for dividing said interior space into a plurality of variable working spaces which increase and decrease as the rotor and the vane are rotated;

an inlet port formed in said housing unit and being open to the suction region of said interior space for feeding a cooling medium into the working spaces when said spaces are increasing;

an outlet port formed in said housing unit and being open to the compression region of said interior space for discharging the cooling medium from the working spaces when said spaces are decreasing;

a rotary valve arranged in said housing unit and having an end face partially exposed to the suction region or the compression region of said interior space, said rotary valve having a return port formed in the end face thereof for feeding the cooling medium into said inlet port from the working spaces when said spaces are decreasing; and actuating means connected to said rotor valve for rotating the rotor valve so as to control the quantity of the cooling medium being discharged from the working spaces through said outlet port.

These and other objects and features of the present invention will become apparent from the following detailed description made with reference to the accompanying drawings.

BRIEF DESCRIPTION OF THE DRAWINGS

FIG. 2 is a sectional view showing the section taken along the line II—II in FIG. 1.

FIGS. 3 and 4 are schematic views illustrating the states of adjustment of the capacity of the rotary compressor shown in FIG. 1.

FIG. 5 is a diagram illustrating the relation between the rotation angle of the rotary valve and the discharge ratio of the working chamber in the rotary compressor shown in FIG. 1.

DETAILED DESCRIPTION OF THE PREFERRED EMBODIMENTS

The present invention will now be described in detail with reference to the embodiments illustrated in the accompanying drawings.

Figure 1:
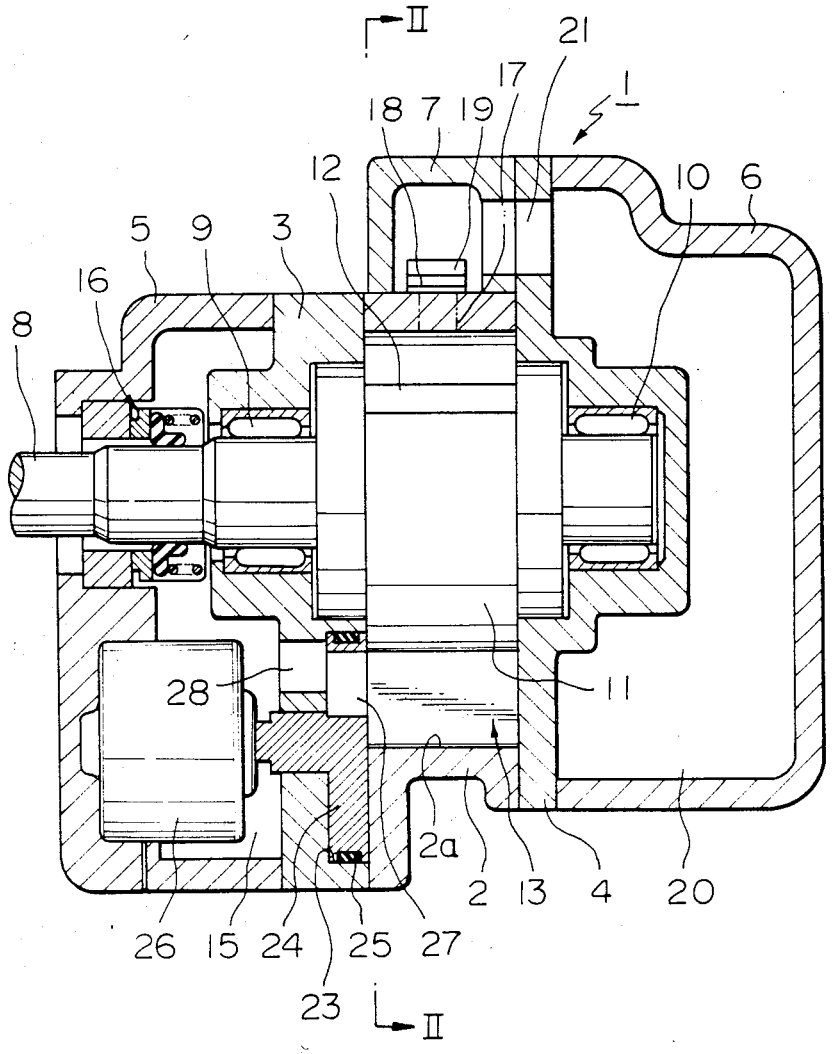
FIG. 1 is a sectional view illustrating a first embodiment of the rotary compressor according to the present invention, which shows the section taken along the line I—I in FIG. 2.

FIGS. 1 and 2 illustrate a first embodiment of the rotary compressor according to the present invention. Referring to FIGS. 1 and 2, a housing unit 1 comprises a cylindrical center housing 2, a first or front side plate 3, a second or rear side plate 4, a first or front side housing 5, a second or rear side housing 6 and a valve housing 7.

The center housing 2 has an inner wall 2*a* of a special contour, and the front side plate 3 and the rear side plate 4 are arranged so that they adhere closely to both end faces of the center housing 2, respectively.

A drive shaft 8 is rotatably supported on the front side plate 3 and rear side plate 4 through bearings 9 and 10. A rotor 11, integrated with the drive shaft 8, is eccentrically arranged within the center housing 2. As shown in FIG. 2, the rotor 11 has two radial slots 11*a* which cross its diameter. Vanes 12 are slidably inserted in slots 11*a*, such that both the ends of each vane 12 are always brought in sliding contact with the inner wall 2*a* of the center housing 2 with the rotation of the rotor 11. Four variable working spaces 13 are defined by the center housing 2, the front side plate 3, the rear side plate 4, the rotor 11 and the vanes 12, and the volume of each working space 13 is changed repeatedly when the rotor 11 and vanes 12 are rotated in the direction of arrow m in FIG. 2.

An inlet port 14 is formed on the front side plate 3 so that the port 14 is opened to each working space 13 at the volume-increasing stage. As shown in FIG. 1, the front side housing 5 is arranged on the outer side wall, that is, the wall on the side opposite to the working space 13, of the front side plate 3. A suction pressure space 15 which communicates with the working space 13 through the inlet port 14 is formed between the front side housing 5 and the front side plate 3. A suction port (not shown) which is open to the suction pressure space 15 is formed on the front side housing 5. This suction port of the front side housing 5 is connectable to an evaporator (not shown) of an automobile cooling system. The drive shaft 8 is extended to the outside through the front side housing 5 and receives the driving force of an automobile engine through an electromagnetic clutch (not shown). A shaft seal device 16 is arranged between the drive shaft 8 and the front side housing 5 to prevent the cooling medium or lubricating oil from leaking to the outside along the drive shaft 8.

An outlet port 17 is formed on the center housing 2 so that the port 17 is opened to each working space 13 at the volume-decreasing stage. The valve housing 7 is attached between the outer face of the center housing 2 and the rear side housing 6 by means of bolts (not shown). A discharge valve 18 and a valve stopper plate 19 for regulating the opening stroke of the valve 18 are arranged within the valve housing 7. The rear side housing 6 is arranged on the outer side wall, that is, the wall on the side opposite to the working space 13 of the rear side plate 4. A discharge pressure space 20 is formed between the rear side housing 6 and the rear side plate 4. The discharge pressure space 20 communicates with the interior of the valve housing 7 through a passage 21 formed on the rear side plate 4 so that when the discharge valve 18 is opened, the discharge pressure space 20 is in communication with the working space 13 through the interior of the valve housing 7 and the outlet port 17. An outlet port (not shown) opened to the discharge pressure space 20 is formed on the rear side housing 6, and the outlet port of the rear side housing 6 is connected to a condenser (not shown) of the automobile cooling system.

The front side housing 5, front side plate 3, center housing 2, rear side plate 4 and rear side housing 6 are secured integrally with one another by means of a plurality of bolts 22.

A cylindrical cavity 23 is formed on the inner side wall of the front side plate 3, and a disc-like rotary valve 24 is rotatably fitted in the cavity 23. The portion intermediate of the rotary valve 24 and the inner circumference of the cavity 23 is sealed by a sealing ring 25. An actuating device 26 for driving and rotating the rotary valve 24 in the normal and reverse directions and controlling the rotation angle of the rotary valve 24 is supported on the front side housing 5. This actuating device 26 may be a step motor which is operated by signals of a control device (not shown) detecting the cooling load and cooling capacity.

The end face of the rotary valve 24 is on the same plane as the inner side wall of the front side plate 3, and a part of the end face of the rotary valve 24 is exposed to the working spaces 13 at the volume-decreasing stage.

A return port 27, having a substantially semicircular shape, is formed on the rotary valve 24, and this port 27 is always in communication with the suction pressure space 15 through a passage 28 formed on the front side plate 3 on the suction pressure space 15. In the specific illustrative embodiment described herein, the position shown for passage 28 illustrated in FIG. 1 is selected primarily to facilitate explanation and comprehension of the invention. In a preferred, practicable embodiment, passage 28 is located as shown in FIG. 2. The opening degree of the port 27 to the working space 13 is changed according to rotation of the rotary valve 24.

The operation of adjusting the quantity of the cooling medium discharged from the working space in the foregoing embodiment will now be described with reference to FIGS. 3 and 4.

When the adjustment of the quantity of the cooling medium discharged from the compressor is not effected, as shown in FIG. 3, the port 27 of the rotary valve 24 is located outwardly of the peripheral inner wall 2*a* of the center housing 2 and the opening degree of the port to the working space 13 is zero. At this time, the quantity of the cooling medium discharged from the working space 13 to the discharge pressure space 20 corresponds to the maximum quantity $V_{max}$ of the cooling medium confined in the working space 13 just after the vane 12 has passed through the inlet port 14. In this state, since the end face of the rotary valve 24 on the side of the working space 13 is on the same plane as the inner side wall of the front side plate 3, substantially no bypass flow of the cooling medium takes place.

When the adjustment of the quantity of the discharge is carried out, the rotary valve 24 is rotated to the position shown in FIG. 4. As described hereinbefore, the rotation angle $\theta$ of the rotary valve 24 is zero if no adjustment is effected. However, in the state shown in FIG. 4, the rotary valve 24 is rotated in the direction of arrow n by the rotation angle $\theta$ of 100° by the actuating device 26. Thus, port 27 communicates with the suction pressure space 15 in the hatched region in FIG. 4 within the inner wall 2*a* of the center housing 2. Accordingly, the quantity of the cooling medium discharged from the working space 13 corresponds to the quantity of the cooling medium confined within the working space 13 just after the vane 12 has passed the port 27 of the rotary valve 24. A ratio of the quantity of the cooling medium discharged from the working space 13 at this time to the quantity obtained when the opening degree of the port 27 to the working space 13 is zero is about 60%. Hereinafter, this ratio is referred to as "discharge ratio R".

Figure 6:
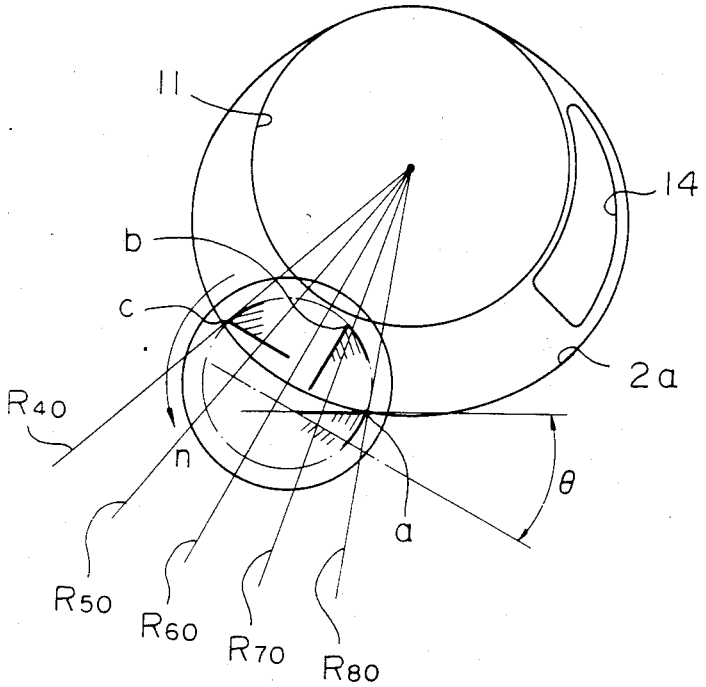
FIG. 6 is a schematic view illustrating the state of rotation of the rotary valve in the rotary compressor shown in FIG. 1.

The geometrical relation between the rotation angle of the rotary valve 24 and the above-mentioned discharge ratio R in the foregoing embodiment is illustrated in FIG. 5. The state of $\theta=30°$ in FIG. 5 corresponds to the state a in FIG. 6 where the port 27 of the rotary valve 24 arrives at the inner wall 2*a* of the center housing 2, and in this state, the discharge ratio R is 80%. The rotation angle $\theta$ of the rotary valve 24 is then increased, and when the rotation angle $\theta$ is 90°, the state b shown in FIG. 6 is produced. When the rotation angle $\theta$ of the rotary valve 24 is increased to 180°, that is, when the opening degree of the port 27 is largest (the state c in FIG. 6), the discharge ratio R is 40%.

In contrast to the above-mentioned geometrical relation between the rotation angle $\theta$ and the discharge ratio R, the discharge ratio R of the practical discharge of the cooling medium is changed, as indicated by a broken line in FIG. 5, in the region where the rotation angle $\theta$ is small and the area P of the opening of the port is relatively small, and when the rotation angle $\theta$ exceeds 30° (R=100%), the opening area P tends to come close to the solid line in FIG. 5 with an increase of the rotation angle $\theta$. Accordingly, the discharge ratio R can be adjusted in the range of from 100% to 40%.

At the start of the rotary compressor, the actuating device 26 is operated so that, as shown in FIG. 2, the rotary valve 24 is set at the state where the adjustment of the quantity of the cooling medium discharged from the working space (R=40%) is effected.

A stepped driving load is imposed on the above-mentioned electromagnetic clutch at the start of the rotary compressor, and this driving load is increased as the quantity of the cooling medium discharged from the working space is increased. Accordingly, the size of the electromagnetic clutch is ordinarily determined according to this stepped load, and it is, therefore, necessary that the electromagnetic clutch should have a much larger power transmission capacity than the power transmission capacity required for the electromagnetic clutch during normal operation, other than the starting operation. Namely, in the case where the quantity of the cooling medium discharged from the compressor cannot be adjusted, an electromagnetic clutch having a large capacity not necessary for normal operation is inevitably used.

In contrast, in the foregoing embodiment of the present invention, by operating the actuating device 26 in the above-mentioned manner, the discharge ratio R at the time of starting can be reduced to about 40%. Accordingly, the starting load imposed on the electromagnetic clutch is drastically reduced, and, hence, the size of the electromagnetic clutch can be reduced.

Furthermore, since the quantity of the cooling medium discharged from the working space is minutely controlled according to the required capacity of the cooler system, as described hereinbefore, the rotary compressor can be kept rotating, without turning off the electromagnetic clutch, within a broad range of the operation conditions of the cooler system, with the result that degradation of the durability of the electromagnetic clutch and rotary compressor and sluggishness of the engine, which are due to the turning-on and turning-off of the electromagnetic clutch, can effectively be prevented. Moreover, the inconsistent degree of cooling due to the delay in the turn-on and turn-off of the electromagnetic clutch can be prevented, and simultaneously, wasteful continuation of the high-efficiency rotation of the rotary compressor can be prevented. Therefore, a high power-saving effect can be attained as a whole.

In the conventional rotary compressor of the type where the cooling capacity is controlled by turning on and off the compressor, when the compressor is stopped, the interior of the evaporator immediately becomes super-heated, and when the rotary compressor is operated again, no cooling effect can be attained before the super-heated region is completely eliminated, and the power required for driving the rotary compressor during this period makes no substantial contribution to attainment of the cooling effect. In the foregoing embodiment of the present invention, in contrast, since the cooling capacity is controlled without stopping the rotary compressor, super-heating of the evaporator, which inevitably occurs in the conventional rotary compressor, does not occur at all, and wasteful running of the compressor can be avoided.

In the foregoing embodiment, since the rotary valve 24 is arranged on the side of the front side plate 3, and the actuating device 26 is disposed in the front side housing 5 on the side of the suction pressure space 15, as shown in FIG. 1, when the port 27 is opened to the working space 13 by the rotation of the rotary valve 24, the interior of the port 27 is immediately maintained at the pressure of the suction pressure space 15, and no power loss is brought about by the capacity adjustment.

This feature is very important in connection with the principle concerning the adjustment of the quantity of the cooling medium discharged from the compressor in the present invention. More specifically, since the cooling medium sucked into the working space 13 from the inlet port 14 is fed to the suction pressure space 15 again from the port 27 of the rotary valve 24, the above-mentioned adjustment can be accomplished. The power necessary for this feeding of the cooling medium should be very small. In other words, the flow resistance between the port 27 of the rotary valve 24 and the suction pressure space 15 should be very small. For example, the mechanism of the present invention for adjusting the quantity of the cooling medium discharged from the working space may be mounted on the rear side plate 4 and connected to the suction pressure chamber 15 through a communicating hole, but if this is done, as is apparent from the foregoing description, the flow resistance is inevitably increased and an additional power loss is brought about.

As will be apparent from the foregoing description, by arranging the rotary valve 24 on the front side plate 3 adjacent to the suction pressure space 15 and disposing the actuating device 26 in the front side housing 5 on the side of the suction pressure space 15, the rotary compressor can be operated very effectively without any additional power loss.

Figure 7:
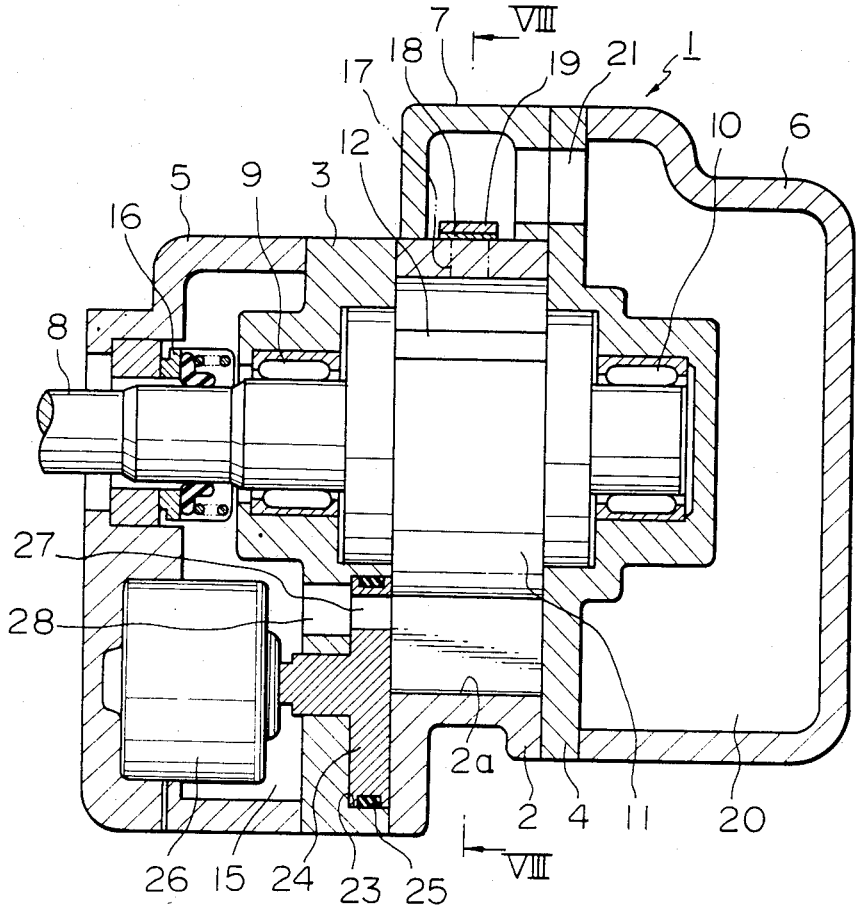
FIG. 7 is a sectional view illustrating a second embodiment of the rotary compressor according to the present invention, which shows the section taken along the line VII—VII in FIG. 8.
Figure 8:
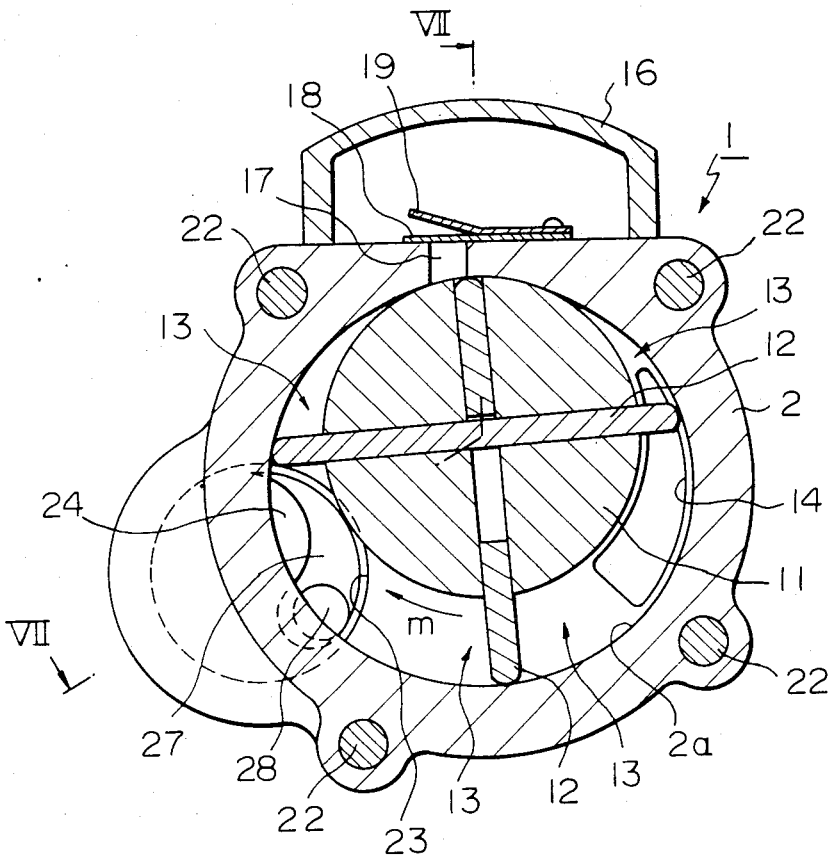
FIG. 8 is a sectional view showing the section taken along the line VIII—VIII in FIG. 7.

FIGS. 7 and 8 illustrate a second embodiment of the present invention. Referring to FIGS. 7 and 8, this second embodiment is different from the above-mentioned first embodiment in that the position of the rotary valve 24 is determined so that the minimum quantity of the cooling medium discharged from the rotary compressor corresponds to about 20% of the maximum quantity and the shape of the port 27 is determined so that the quantity of the cooling medium discharged from the compressor is substantially proportional to the rotation angle of the rotary valve. Other structural features of the second embodiment are the same as those of the first embodiment. The same structural elements as in the first embodiment are indicated in FIGS. 7 and 8 by the same reference numerals as used in FIGS. 1 and 2.

Figure 9:
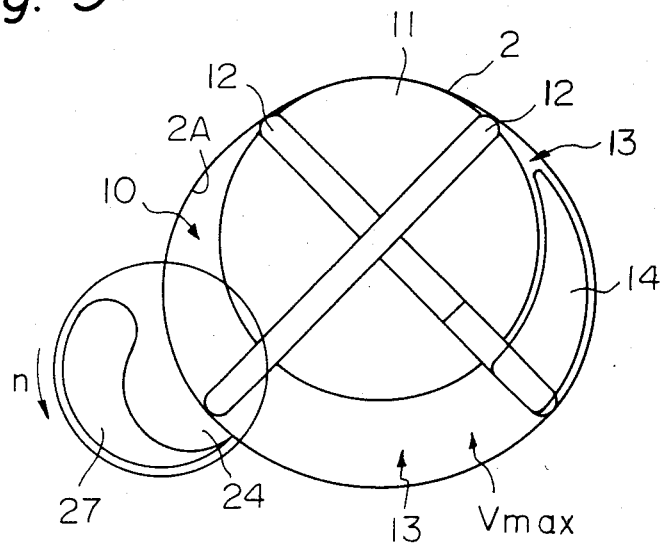
FIGS. 9 and 10 are schematic views illustrating the operational state of the rotary compressor shown in FIG. 7.

In this second embodiment, when the adjustment of the quantity of the cooling medium discharged from the compressor is not made, as shown in FIG. 9, the port 27 of the rotary valve 24 is located outwardly of the inner wall 2*a* of the center housing 2, and the opening degree of the port 27 to the working space 13 is zero. At this time, the quantity of the cooling medium discharged to the discharge pressure space 20 from the working space 13 corresponds to the maximum quantity $V_{max}$ of the cooling medium confined within the working space 13 just after the vane 12 has passed through the inlet port 14.

Figure 10:
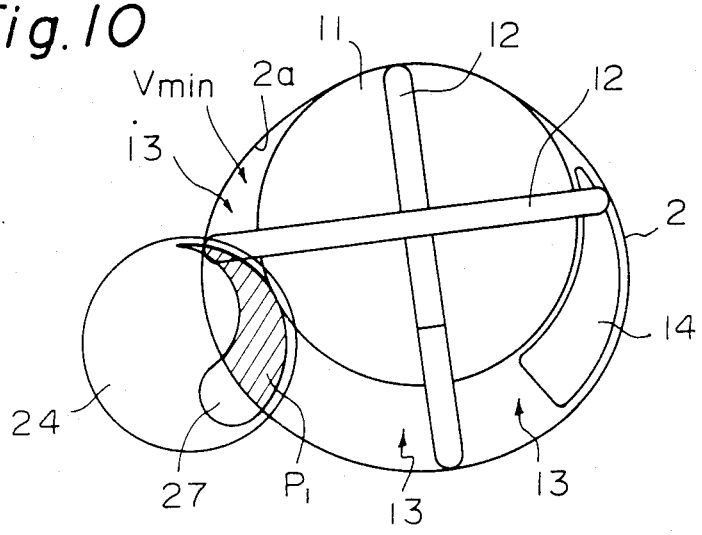

When the adjustment of the quantity of the discharge is carried out, the rotary valve 24 is rotated in the normal direction, indicated by an arrow n in FIG. 9, and, at the position shown in FIG. 10, the opening degree of the port 27 is largest. Namely, the port 27 communicates with the working space 13 in the hatched region $P_1$ in FIG. 10. In this state, when the working space 13 enters in the volume-decreasing stage, the working space 13 communicates with the suction pressure space 15 through the port 27 and passage 28 until the vane 12 passes through the opening region of the port 27. Accordingly, the quantity of the cooling medium discharged into the dischage pressure space 20 from the working space 13 corresponds to the minimum quantity $V_{min}$ of the cooling medium confined in the working space 13 just after the vane has passed the opening region of the port 27. Incidentally, the shapes and positions of the rotary valve 24 and port 27 are determined so that the port 27 is opened into the working space 13 just after the vane 12 has passed through the inlet port 14.

Figure 11:
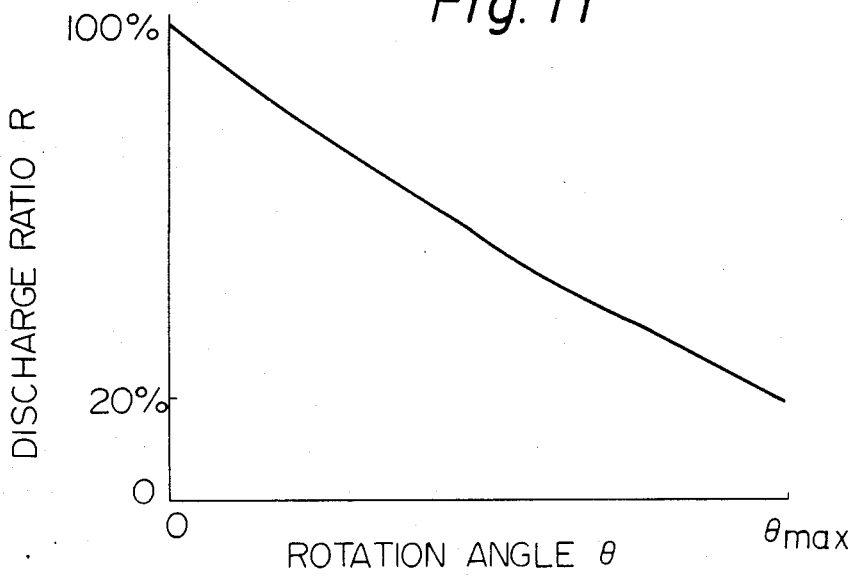
FIG. 11 is a diagram showing the relation between the rotation angle of the rotary valve and the discharge ratio in the rotary compressor shown in FIG. 7.

FIG. 11 illustrates the relationship between the rotation angle $\theta$ of the rotary valve 24 and the discharge ratio R in the second embodiment. In FIG. 11, the rotation angle $\theta$ of the rotary valve 24 when the port 27 is fully closed is set at 0° and the rotation angle $\theta$ of the rotary valve 24 when the opening degree of the port 27 is largest is expressed as $\theta_{max}$. The discharge ratio is about 20%.

In the rotary compressor, the adjustment of the quantity of the discharge should be carried out within a broad range so that the cooling capacity corresponds to the cooling load. Accordingly, it is ordinarily preferred that the quantity of the discharge be reduced to a quantity as small as possible. However, from the results of experiments made by us, it has been confirmed that, in order to maintain the durability or efficiency of the rotary compressor at a high level, it is necessary that the minimum quantity of the cooling medium discharged from the compressor should not be smaller than about 20% of the maximum quantity.

Figure 12:
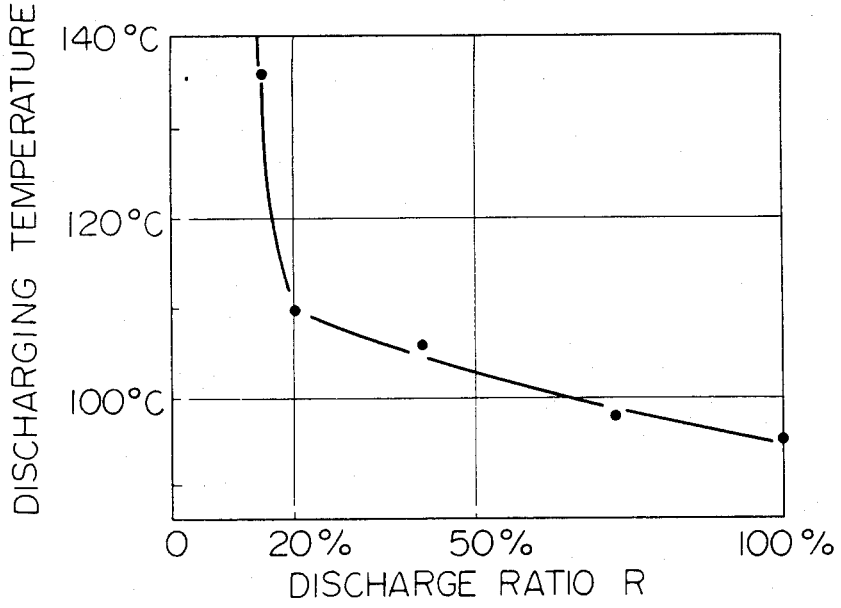
FIG. 12 is a diagram illustrating the relation between the discharge ratio and the discharge temperature.

These experimental results will now be described: FIG. 12 illustrates the results of the experiment in which predetermined amounts of a cooling medium gas and a lubricating oil for refrigerating machine were filled in an ordinary cooler system for an automobile and illustrates the relationship between the discharge ratio R and the discharging temperature Td in the rotary compressor, which was arranged so that the discharge ratio R can be reduced below 20%. As is seen from FIG. 12, if the discharge ratio R is lower than about 20%, the discharging temperature Td is abruptly elevated. In this experiment, when the cooling medium gas and lubricating oil flowing into the rotary compressor were observed by using a sight glass, it was seen that if the discharging temperature was increased, flow-in of the lubricating oil into the rotary compressor was reduced and became undetectable. Thus, it has been confirmed that if the discharge ratio R is lower than about 20%, the durability of the bearing or shaft sealing device in the rotary compressor is drastically degraded.

Figure 13:
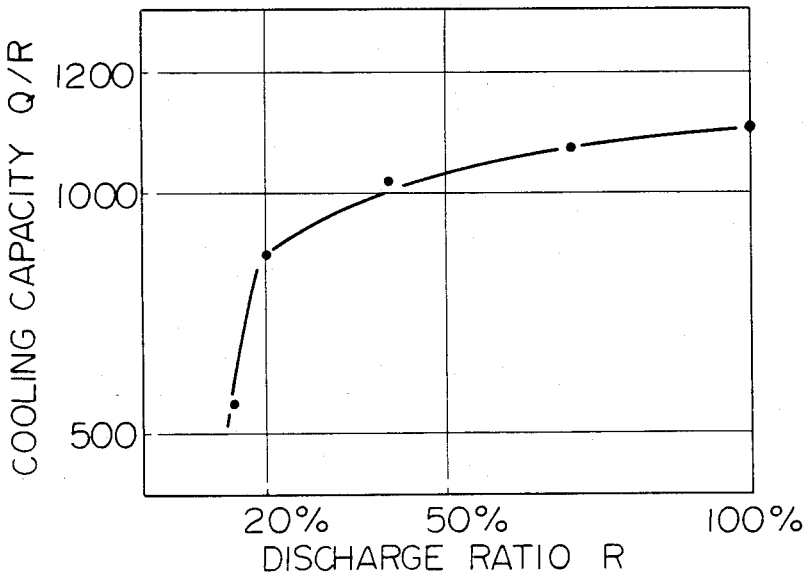
FIG. 13 is a diagram illustrating the relation between the discharge ratio and the cooling capacity per unit power.

FIG. 13 illustrates the results of the relationship between the discharge ratio R and the cooling capacity per unit power, that is, Q/P (kcal/h/Ps). The value Q/P is ordinarily used for evaluation of the efficiency of the compressor. As is apparent from FIG. 13, if the discharge ratio R is lower than about 20%, the cooling capacity Q/P per unit power is drastically reduced. Incidentally, this experiment is carried under conditions of a rotation number of 2000 r.p.m., a suction pressure of 2.5 $Kg/cm^2$ abs., a discharging pressure of 16 $Kg/cm^2$ abs. and a sucked gas temperature of 3° C. by using a rotary compressor having a maximum discharging capacity of 100 cc per rotation.

In view of the foregoing experimental results, in the rotary compressor according to the present invention, the position of the rotary valve 24 is determined so that the minimum discharge ratio R should be at least about 20%. Accordingly, a drastic reduction of the efficiency or durability of the rotary compressor does not occur. The discharge ratio R may be set at any appropriate value according to the variation range of the cooling load, so far as it is not less than about 20%.

In the foregoing second embodiment, as shown in FIG. 11, the discharge ratio R is changed substantially proportionally to the rotation angle $\theta$ of the rotary valve 24. Accordingly, control of the adjustment of the discharge ratio R can be performed very easily over the entire range.

Figure 14:
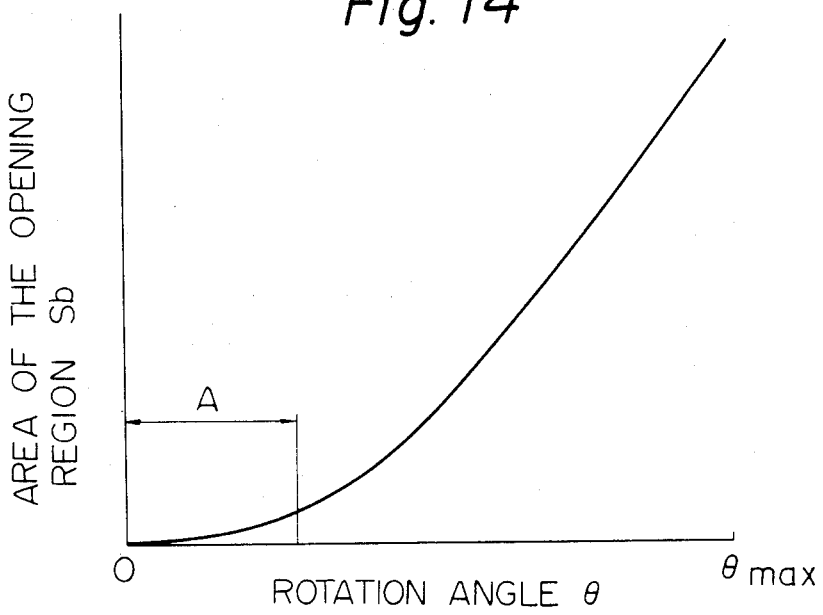
FIG. 14 is a diagram illustrating the relation between the rotation angle of the rotary valve and the area of the opening region of the port in the rotary compressor shown in FIG. 7.
Figure 15:
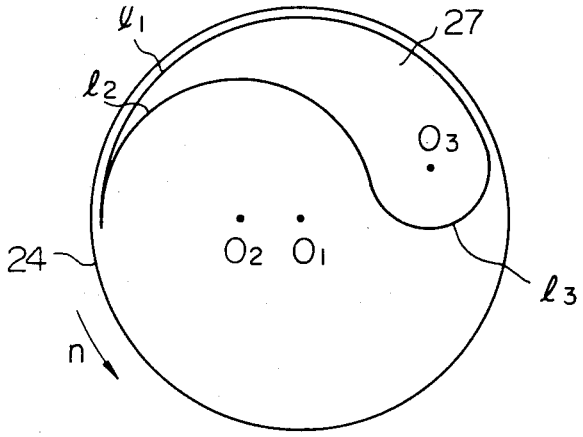
FIG. 15 is a simplified schematic view illustrating an example of the shape of the return port in the rotary compressor shown in FIG. 7.

In order to change the discharge ratio R substantially proportionally to the rotation angle $\theta$ of the rotary valve 24, it is necessary that, as shown in FIG. 14, an increase of the area Sb of the opening of the port 27 when the port 27 of the rotary valve 24 begins to move to the working space 13 from the fully closed state (region A in FIG. 14) should be effected very gently according to the increase of the rotation angle $\theta$ of the rotary valve 24, whereby an abrupt decrease of the quantity of the cooling medium discharged from the working space just after initiation of opening of the port 27 can be prevented. In the second embodiment, the above requirement is satisfied by imparting a specific contour, as shown in FIG. 15, to the port 27. More specifically, the outer arc l1 of the port 27 is a part of the circle having its center located at the center $O_1$ of the rotary valve 24, and the inner arc l2 of the port 27 is a part of the circle having its center located at the point $O_2$, which is offset from the center $O_1$ of the rotary valve 24. One end of the inner arc l2 is substantially tangent to one end of the outer arc l1, and the other end of the inner arc l2 is connected to the other end of the outer arc l1 through an arc l3 which is a part of the circle having its center located at the point $O_3$. Incidentally, in FIG. 15, the arrow n indicates the rotation direction of the rotary valve 24.

Figure 16:
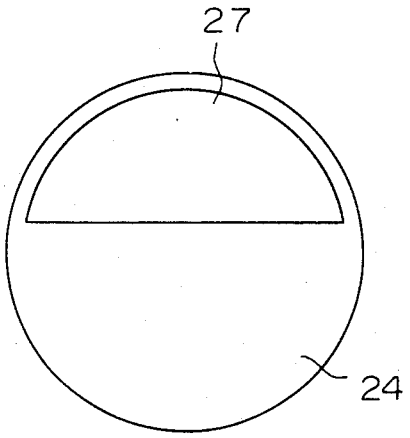
FIG. 16 is a simplified schematic view illustrating another example of the shape of the port in the rotary compressor according to the present invention.
Figure 17:
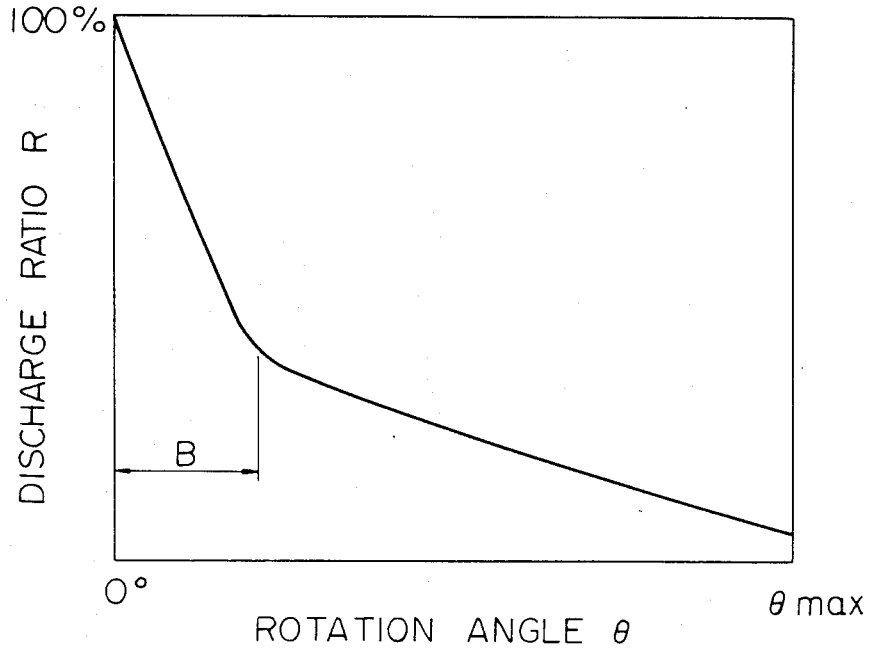
FIG. 17 is a diagram illustrating the relation between the rotation angle of the rotary valve and the discharge ratio in the rotary compressor having the return port shown in FIG. 16.
Figure 18:
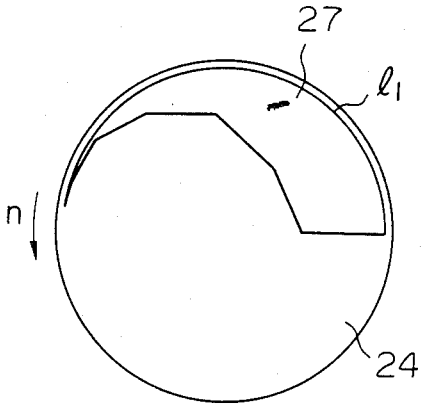
FIGS. 18 through 21 are simplified schematic views illustrating respective examples of the shape of the return port in the rotary compressor according to the present invention.
Figure 20:
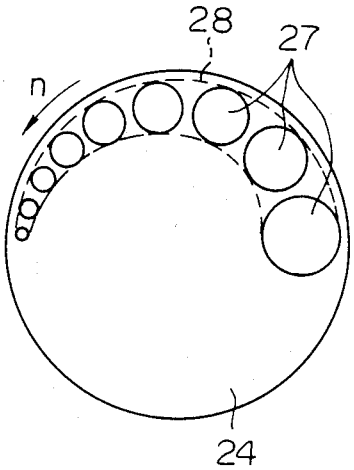
Figure 19:
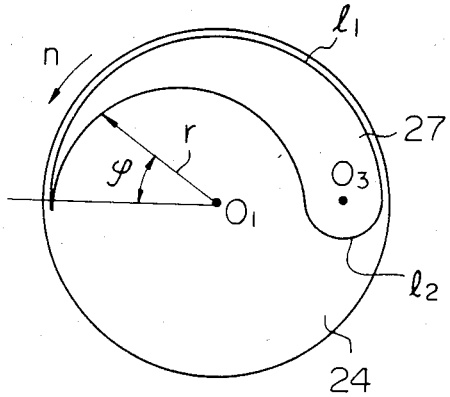
Figure 21:
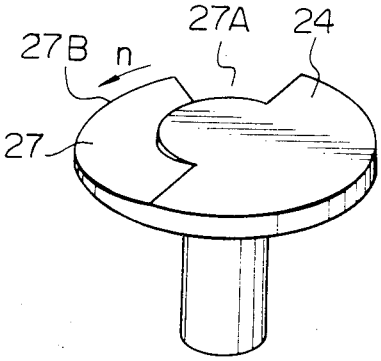

In the present invention, there may be adopted a modification in which a rotary valve 24 having a semicircular port shape, as shown in FIG. 16, is used and the position of the rotary valve 24 is determined so that the minimum discharge ratio R is about 20%. In this modification, however, the discharge ratio R is not changed proportionally to the rotation angle $\theta$ of the rotary valve 24, as shown in FIG. 17, but an abrupt decrease of the discharge ratio R is caused in the initial stage of the opening of the port (region B in FIG. 17).

FIGS. 18 through 21 illustrate modifications of the port 27 in the present invention. In each modification, the port 27 of the rotary valve 24 has such a shape that the discharge ratio R can be changed substantially proportionally to the rotation angle $\theta$ of the rotary valve 24. The port 27 shown in FIG. 18 has a shape of an arc, a part of which is replaced by a plurality of straight lines, and the port 27 shown in FIG. 19 has the same shape as the shape shown in FIG. 15, except that the inner arc l2 is replaced by a curve of $r=a\phi^2+b\phi$. The port 27 shown in FIG. 20 has a shape comprising a plurality of circles differing in diameter, which are arranged in the order of the diameter size. In this modification, it is necessary that a passage 28, having, for example, a shape as indicated by a broken line in FIG. 20, should be formed on the front side plate so that communication between the working space and the suction pressure space can be effected through all of the foregoing circles. The port 27 shown in FIG. 21 has a shape comprising a periphery-notched portion 27A and an inclined groove portion 27B gradually inclined in the arcuate direction toward the notched portion 27A.

It is to be understood that the particular embodiments herein described are exemplary and illustrative of the invention and certain changes may be made within the range defined in the claims and also within the range obvious to those skilled in the art. Furthermore, it is obvious that the rotary compressor of the present invention may be applied to not only a cooling system for an automobile, but also to an ordinary household air conditioner or freezer.

We claim:

1. A rotary compressor for a cooling medium, the rotary compressor comprising:

a housing unit comprising a center housing which has opposite ends and a peripheral inner wall extending between said opposite ends, first and second side plates, each having an inner side face arranged on the corresponding opposite end of said center housing for defining part of an interior space between said inner side faces of said first and second plates;

a rotor eccentrically and rotatably arranged within said housing unit, said rotor and said peripheral inner wall further defining therebetween said interior space;

vane means slidably mounted on said rotor and extending in a radial direction of said rotor, said vane means having ends each of which continuously sealingly contacts said peripheral inner wall of said housing unit for dividing said interior space into a plurality of movable and variable working spaces;

an inlet port formed in said housing unit and being open to said interior space for feeding the cooling medium into said working spaces;

an outlet port formed in said housing unit and being open to said interior space for discharging the cooling medium from said working spaces, said interior space having a suction region, a discharge region, and a compression region located between said suction region and said discharge region, each of said working spaces successively passing through said suction region in which each of said working spaces is connected to said inlet port, said compression region in which each of said working regions is disconnected from said inlet and outlet ports, and said discharge region in which each of said working spaces is connected to said outlet port;

a rotary valve arranged in said housing unit and having therein a return port which is able to be open to each of said working spaces located in said compression region for returning the cooling medium in each of said working spaces to said inlet port, said return port having an opening region which is expandable in a direction of the movement of said working spaces in accordance with the rotational movement of said rotary valve for changing a timing of the start of the compression action of said working spaces, said rotary valve having an end face which forms a portion of said inner side face of said first side plate and which is partially exposed in said interior space, said return port being formed in said end face of said rotary valve, said first side plate having a cylindrical cavity for supporting said rotary valve; and an actuating means connected to said rotary valve for rotating said rotary valve, wherein said housing further comprises a first side housing which is arranged on said first side plate, so as to form a suction pressure space therebetween, said suction pressure space being in communication with said return port of said rotary valve and said inlet port formed in said first side plate, and wherein said actuating means is fixed onto said first side housing and connected to said rotary valve, which extends into said suction pressure space through said first side plate.

2. A rotary compressor according to claim 1, wherein said first side plate has a passage formed thereon and connects said return port to said suction pressure space.

3. A rotary compressor for a cooling medium, the rotary compressor comprising:

a housing unit comprising a center housing which has opposite ends and a peripheral inner wall extending between said opposite ends, first and second side plates, each having an inner side face arranged on the corresponding opposite end of said center housing for defining part of an interior space between said inner side faces of said first and second plates;

a rotor eccentrically and rotatably arranged within said housing unit, said rotor and said peripheral inner wall further defining therebetween said interior space;

vane means slidably mounted on said rotor and extending in a radial direction of said rotor, said vane means having ends each of which continuously sealingly contacts said peripheral inner wall of said housing unit for dividing said interior space into a plurality of movable and variable working spaces;

an inlet port formed in said housing unit and being open to said interior space for feeding the cooling medium into said working spaces;

an outlet port formed in said housing unit and being open to said interior space for discharging the cooling medium from said working spaces, said interior space having a section region, a discharge region, and a compression region located between said suction region and said discharge region, each of said working spaces successively passing through said suction region in which each of said working spaces is connected to said inlet port, said compression region in which each of said working regions is disconnected from said inlet and outlet ports, and said discharge region in which each of said working spaces is connected to said outlet port;

a rotary valve arranged in said housing unit and having therein a return port which is able to be open to each of said working spaces located in said compression region for returning the cooling medium in each of said working spaces to said inlet port, said return port having an opening region which is expandable in a direction of the movement of said working spaces in accordance with the rotational movement of said rotary valve for changing a timing of the start of the compression action of said working spaces, said rotary valve having an end face which forms a portion of said inner side face of said first side plate and which is partially exposed in said interior space, said return port being formed in said end face of said rotary valve, said first side plate having a cylindrical cavity for supporting said rotary valve; and an actuating means connected to said rotary valve for rotating said rotary valve, wherein said housing further comprises a first side housing which is arranged on said first side plate, so as to form a suction pressure space therebetween, said suction pressure space being in communication with said return port of said rotary valve and said inlet port formed in said first side plate, and wherein said rotary valve has a cylindrical outer surface which is fitted into a cylindrical inner wall of the cavity of said first side plate, a sealing ring being inserted between said rotor valve and said cylindrical inner wall of said cavity.

4. A rotary compressor according to claim 3, wherein said return port has a profile comprising a plurality of circles having different diameters, said plurality of circles being arranged in the order of the diameter sizes in the rotating direction of said rotary valve, so that the quantity of the cooling medium discharged from said working spaces through said outlet port is substantially proportional to the rotation angle of said rotary valve.

5. A rotary compressor according to claim 3, wherein said return port has a shape comprising a notched periphery portion and a circumferentially extending inclined groove portion having a depth which is increased toward said notched periphery portion, so that the quantity of the cooling medium discharged from said working space through said outlet port is substantially proportional to the rotation angle of said rotary valve.

6. A rotary compressor according to claim 3, wherein the position of said rotary valve is predetermined such that the minimum quantity of the cooling medium discharged from the working space through said outlet port is not less than about 20% of a maximum quantity of the cooling medium discharged from said working space through said outlet port.

7. A rotary compressor for a cooling medium, the rotary compressor comprising:

a housing unit having therein a peripheral inner wall;

a rotor eccentrically and rotatably arranged within said housing unit, said rotor and said peripheral inner wall defining therebetween an interior space;

vane means slidably mounted on said rotor and extending in a radial direction of said rotor, said vane means having ends each of which continuously sealingly contacts said peripheral inner wall of said housing unit for dividing said interior spaces into a plurality of movable and variable working spaces;

an inlet port formed in said housing unit and being open to said interior space for feeding the cooling medium into said working spaces;

an outlet port formed in said housing unit and being open to said interior space for discharging the cooling medium from said working spaces, said interior space having a suction region, a discharge region, and a compression region located between said suction region and said discharge region, each of said working spaces successively passing through said suction region in which each of said working spaces is connected to said inlet port, said compression region in which each of said working regions is disconnected from said inlet and outlet ports, and said discharge region in which each of said working spaces is connected to said outlet port;

a rotary valve arranged in said housing unit and having therein a return port which is able to be open to each of said working spaces located in said compression region for returning the cooling medium in each of said working spaces to said inlet port, said return port having an opening region which is expandable in a direction of the movement of said working spaces in accordance with the rotational movement of said rotary valve for changing a timing of the start of the compression action of said working spaces; and an actuating means connected to said rotary valve for rotating said rotary valve, wherein said expandable opening region of said return port comprises a stationary first end portion, at which said vane initially comes into engagement with said expandable opening region for connecting the working space to said expandable opening region, and a movable second end portion, at which said vane disconnects said working space from said expandable opening region, and further wherein said return port is a single aperture passing through said rotary valve, and said single aperture has a profile which comprises an outer arc section, having its center located at a center of said rotary valve, and an inner junction section, which extends between opposite ends of said outer arc section.

8. A rotary compressor according to claim 7, wherein said inner junction section forms a single straight line.

9. A rotary compressor according to claim 7, wherein a distance between said inner junction section and said outer arc section of said profile decreases in the rotating direction of said rotary valve so that a quantity of the cooling medium which is discharged from said working space through said outlet port is substantially proportional to a rotation angle of said rotary valve.

10. A rotary compressor according to claim 9, wherein said inner junction section of said profile comprises a first junction portion and a second junction portion for connecting one end of said first junction portion to one end of said outer arc section, said first junction portion being convex toward said outer arc section, and an other end of said first junction portion being substantially inscribed with said other end of said outer arc section.

11. A rotary compressor according to claim 10, wherein said first junction portion of said inner junction section is a part of a circle having its center located at a point deviated from said center of said rotary valve.

12. A rotary compressor according to claim 10, wherein said first junction portion of said inner junction section is an arc in which a distance r is increased in accordance with an increase in an angle $\phi$:

where r is a distance between said center of said rotary valve and a given point on said first junction portion;

$\phi$ is an angle between a reference line and a straight line passing through said center of said rotary valve and said given point on said first junction portion; and said reference line is a line passing through said center of the rotary valve and one end of said outer arc section.

13. A rotary compressor according to claim 12, wherein said arc is represented by the equation $r=a\phi^2+b\phi$, where a and b are constant.

* * * * *

UNITED STATES PATENT AND TRADEMARK OFFICE

CERTIFICATE OF CORRECTION

PATENT NO. : 4,502,850

DATED : March 5, 1985

INVENTOR(S) : M. Inagaki et al.

It is certified that error appears in the above-identified patent and that said Letters Patent is hereby corrected as shown below:

Column 1, line 34, change "load" to --loading--.

Column 1, line 51, before "type" insert --variable capacity--.

Signed and Sealed this

*Tenth* Day of *September 1985*

[SEAL]

*Attest:*

DONALD J. QUIGG

*Attesting Officer* *Acting Commissioner of Patents and Trademarks - Designate*